US005432954A

United States Patent [19]

Taylor

[11] Patent Number: 5,432,954

[45] Date of Patent: Jul. 18, 1995

[54] OIL FILTER CHANGE GLOVE

[76] Inventor: Joseph C. Taylor, 1110 Wingfield Ave., Chesapeake, Va. 23325

[21] Appl. No.: 167,206

[22] Filed: Dec. 16, 1993

[51] Int. Cl.[6] ..... A41D 19/00

[52] U.S. Cl. ..... 2/161.6; 2/158; 2/159

[58] Field of Search ..... 2/158, 159, 160, 161.6, 2/162, 163, 16

[56] References Cited

U.S. PATENT DOCUMENTS

| | | | |
|---|---|---|---|
| 4,214,317 | 7/1980 | Kelly, Sr. | 2/161 R |
| 4,485,853 | 12/1984 | Gunderson | 141/1 |
| 4,564,956 | 1/1986 | DiBuono | 2/16 |
| 4,733,412 | 3/1988 | Campbell | 2/162 |
| 4,860,385 | 8/1989 | Zidele | 2/163 |
| 4,937,881 | 7/1990 | Heise | 2/163 |
| 4,964,188 | 10/1990 | Olson | 2/160 |
| 5,121,776 | 6/1992 | Kovach | 141/98 |
| 5,172,427 | 12/1992 | Van Bergen et al. | 2/158 |
| 5,196,244 | 3/1993 | Beck | 2/158 |
| 5,320,145 | 6/1994 | Avino | 2/16 |

*Primary Examiner*—Clifford D. Crowder
*Assistant Examiner*—Bibhu Mohanty
*Attorney, Agent, or Firm*—Griffin, Butler, Whisenhunt & Kurtossy

[57] ABSTRACT

An oil filter change glove (8) comprises a tubularly shaped, flexible, outer glove member (10) having a flexible pocket (22) with a pocket-rim end (28) thereof attached to a filter-receiving end (20) of the outer glove member to form a pocket interior (30) in a tube interior (12). The pocket is shaped and sized for receiving a filter (44) inserted through the pocket-rim end into the pocket interior and the outer glove member is shaped and sized for receiving a hand inserted through a hand-receiving end (16) into the tube interior for gripping the pocket and the filter enclosed therein for manipulating the filter. A pocket wall is attached to the outer glove member at two seams (36*a* and *b*) running longitudinally of the tubularly shaped outer glove member for forming a finger slot (38).

3 Claims, 1 Drawing Sheet

OIL FILTER CHANGE GLOVE

BACKGROUND OF THE INVENTION

This invention relates broadly to devices for aiding in changing oil filters, and particularly to devices for aiding in changing motor-vehicle oil filters.

Persons who change oil either for a business or for their own personal vehicles, often have difficulty quickly removing old oil filters without soiling themselves or their surroundings. In this regard, quite often when oil of a motor vehicle is changed the oil, and an oil filter, or oil filter canister through which the oil has been flowing, are quite hot. Although oil filter canisters can be screwed off with oil-filter wrenches, it is often difficult to move the wrenches into proper positions for quickly removing the filters. Thus, although oil-filter wrenches are often used for initially loosening oil filter canisters, people usually prefer to unscrew the oil filter canisters by hand. If oil-filter wrenches are used for completely unscrewing oil filters, the oil filters can easily fall to the ground when they are released from their mounts, thereby spilling oil in undesired places. Similarly, if oil filters are unscrewed by hand, because they are hot, they not only burn fingers but still often fall when they are released from their mounts.

Although some people wear gloves when they change oil filters, many gloves are cumbersome so that heavy oil filters sometimes slip to the ground when they are released from their mounts, again, spilling oil in inappropriate places. Also, most gloves are permeable to oil so that they allow a person's hands to get soiled when he uses them to change oil.

Thus, it is an object of this invention to provide an oil filter change glove which is easy to use, relatively inexpensive to manufacture, protects users from heat and soilage, and prevents users from inadvertently dropping oil filters when they are released from their mounts.

SUMMARY

According to principles of this invention, a pocket-rim end of a cup-shaped pocket wall of a flexible pocket is attached to a filter rim of a tubularly-shaped, flexible, outer glove member, with the pocket wall extending into a tube interior of the outer glove member to form a pocket interior therein. The outer glove member and the pocket are shaped and sized for receiving an oil filter canister inserted through the filter rim of the outer glove member and the pocket rim of the pocket into the pocket interior and for receiving a hand inserted through a hand rim into a tube interior of the flexible outer glove member for gripping the pocket and the filter, or filter canister, enclosed in the pocket interior to manipulate the oil filter. A pocket wall is also attached to the outer glove member at seams running longitudinally of the tubularly-shaped outer glove member for forming a finger slot between the outer glove member and the pocket wall for receiving a finger. Both the outer glove member and the pocket are constructed of an oil-impervious cloth-like material.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
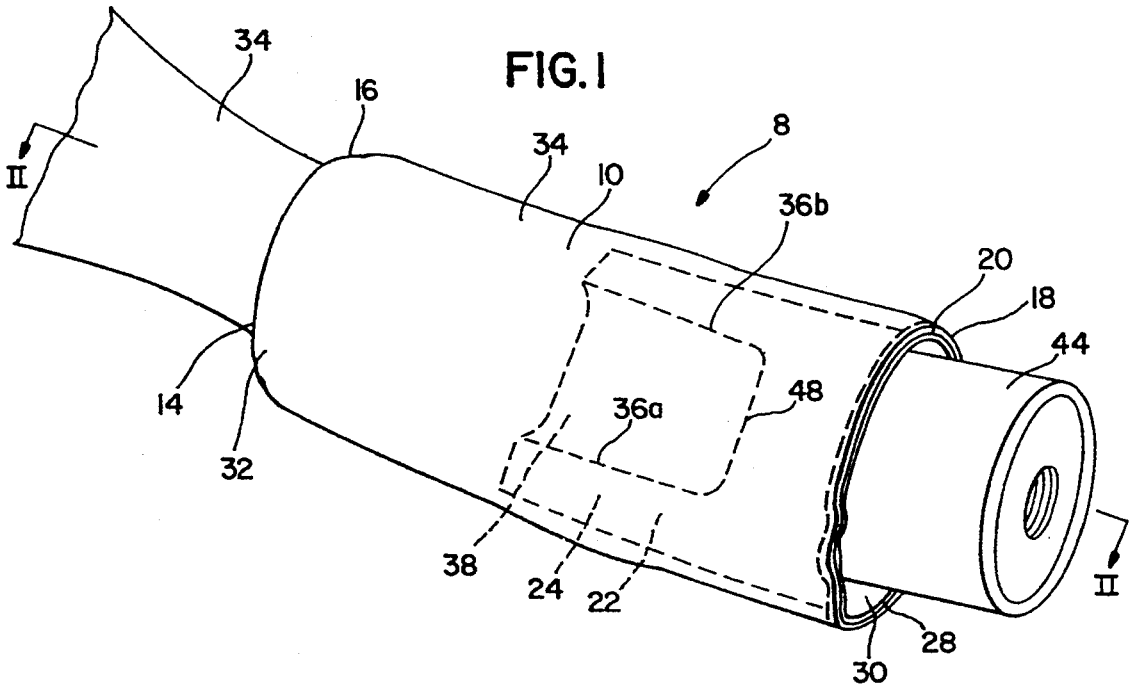
FIG. 1 is an isometric view of an oil filter change glove of this invention with an oil filter being partially inserted into a pocket-rim end thereof and a hand inserted into a hand-rim end thereof.

An oil filter change glove 8 comprises a tubularly-shaped, flexible, outer glove member 10 of oil-impervious cloth-like material for defining a tube interior 12 with a hand rim 14 at a hand-receiving end 16 and a filter rim 18 at a filter-receiving end 20.

Figure 2:
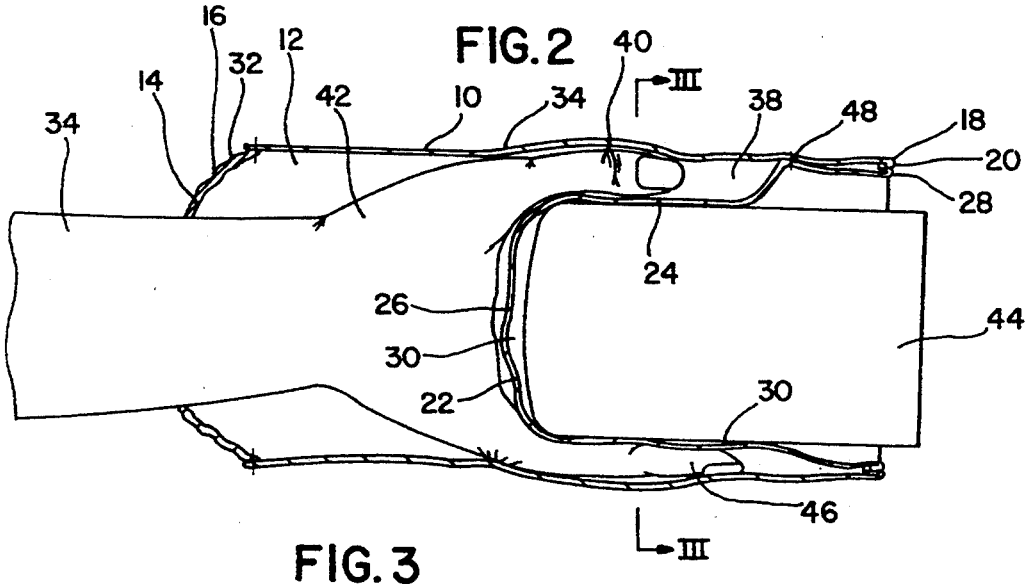
FIG. 2 is a side sectional view taken on line II—II in FIG. 1 but with the oil filter being further inserted into the oil filter change glove.
Figure 3:
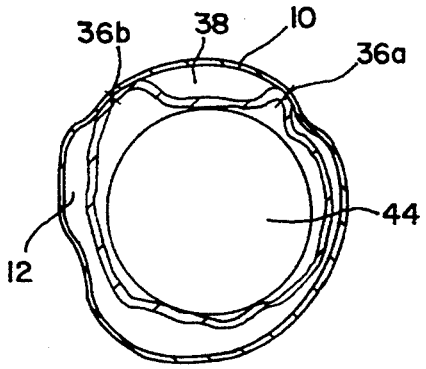
FIG. 3 is a cross-sectional view taken on line III—III in FIG. 2 but with the hand being removed for clarity.

The oil filter change glove 8 further comprises a flexible pocket 22 having a cup-shaped pocket wall 24 of oil-impervious cloth-like material with a closed interior end 26 and an open opposite pocket-rim end 28. The pocket-rim end 28 is sewn, or otherwise attached, to the filter rim 18 of the outer glove member 10, with the pocket wall 24 extending into the tube interior 12 to thereby define a pocket interior 30 which is positioned in the tube interior 12. With regard to the pocket-rim end 28 being sewn to the filter rim 18, this is done by turning both these members inside out from their attitudes as depicted in FIG. 2, with the pocket-rim end 28 being placed adjacent to the filter rim 18. Once these members are thusly sewn together, they are then turned inside out to have the attitudes depicted in FIG. 2.

Both the outer glove member 10 and the flexible pocket 22 are constructed of a flexible cloth-like material which is impervious to oil. An annularly-shaped elastic member 32 may be attached to the outer glove member 10 at its hand-receiving end 16 to contract the hand-receiving end 16 onto an arm 34 inserted into the hand-receiving end 16.

In addition to the pocket wall 24 being sewn to the outer glove member 10 at the filter rim 18, the pocket wall 24 is also sewn to a tubular wall 34 of the outer glove member 10 along two seams 36*a* and *b* which run parallel to a longitudinal axis of the tubular wall 34 so as to form a finger slot 38 between the pocket wall 24 and the tubular wall 34 for receiving a thumb 40 of a hand 42 inserted into the oil filter change glove.

The pocket 22 is shaped and sized for receiving an oil filter 44 (the expression "oil filter" is used here to designate a filter element and a housing, or canister, in which it is mounted) relatively snugly when the oil filter is inserted through the pocket rim 28 of the pocket into the pocket interior 30 and the outer glove member 10 is shaped and sized for receiving the hand 42 inserted through the hand rim 14 into the tube interior 12 for gripping the pocket 22 and the oil filter 44 enclosed therein for manipulating the oil filter 44.

In use, one inserts his hand 42 through the hand rim 14 of the outer glove member 10, inserting his thumb 40 into the finger slot 38, with his other fingers 46 positioned between the pocket wall 24 and the tubular wall 34 to surround the flexible pocket 22. It will be appreciated that the parallel seams 36*a* and 36*b* retain the pocket wall 24 in the tube interior 12 in a position which enables one to easily surround the pocket wall 24 with his hand as depicted in FIG. 2. In the embodiment depicted in the drawings, the finger slot 38 is closed at a closing seam 48 which joins the parallel seams 36*a* and 36*b* at an end thereof, however, this closing seam 48 is not necessary in all cases.

In any event, once the user has inserted his hand 42 into the oil filter change glove 8 he manipulates his hand, and the glove 8 mounted thereon, so as to move an oil filter 44 mounted on a motor vehicle through the filter rim 18 of the outer glove member 10 and the pocket rim 28 into the tube interior 12 and into the pocket interior 30. Once the oil filter 44 is fully within the pocket interior 30 so that the hand 42 surrounds the pocket 22 and the oil filter 44, with the thumb 40 on one side and the other fingers 46 on the other side, the user alternately grips and releases the oil filter 44 with his hand while rotating the oil filter 44 from its mount (not shown). When the oil filter releases its mount, since the oil filter 44 fits the pocket interior 30 relatively snugly, the hand 42 is given aid in controlling and holding the oil filter 44 so that the oil filter does not fall from the user, spilling oil in an inappropriate place.

While the invention has been particularly shown and described with reference to a preferred embodiment, it will be understood by those skilled in the art that various changes in form and detail may be made therein without departing from the spirit and scope of the invention. For example, in one embodiment, an interior surface of the pocket wall 24 is formed by a high-friction material to aid a user in gripping the oil filter 44 more tightly when he is turning it.

It will be understood by those of ordinary skill in the art that the oil filter change glove of this invention not only protects a user from soiling himself when removing an oil filter, but also protects the user from the heat of an oil filter and thereby allows him to more tightly grip and control the oil filter.

Further, by placing a high-friction material between a user's fingers and the oil filter the user's grip on the oil filter is enhanced so that the user can more easily rotate the oil filter and hold it.

It is also highly beneficial that the oil filter change glove of this invention forms a cylindrically-shaped pocket interior which somewhat fits the shape of an oil filter because this also enables a user to more easily control and grip an oil filter when the oil filter releases from its mount so that the user is not as likely to drop the oil filter.

By sewing substantially parallel seams to form a finger slot between the flexible pocket and the tubular outer glove member a user is given a reference point for insuring that his hand is surrounding the pocket. Also, this structure holds the pocket in the interior of the tubular outer glove member so that, again, a user can more easily encircle the pocket with his fingers. In another embodiment there is only one parallel seam and in yet another embodiment more parallel seams are included. In still another embodiment there is no closing seam 48.

While the invention has been particularly shown and described with reference to a preferred embodiment, it will be understood by those of ordinary skill in the art that various changes in form and detail may be made therein without departing from the spirit and scope of the invention.

The embodiments of the invention in which an exclusive property or privilege are claimed are defined as follows:

I claim:

1. A method of changing an oil filter comprising the steps of:

providing a tubularly-shaped, flexible, outer glove member of cloth-like material for defining a tube interior, said outer glove member having a hand rim at a hand-receiving end thereof and a filter rim at a filter-receiving end thereof and providing a flexible pocket having a tubularly-shaped pocket wall of cloth-like material with a closed interior end and an open opposite pocket-rim end, said pocket-rim end being attached to said filter-receiving end of said outer glove member with said pocket wall extending into said tube interior to form a pocket interior in the tube interior;

inserting a hand through said hand rim into said tube interior;

manipulating said oil filter change glove with said hand inserted therein to simultaneously insert a filter through said filter rim of said outer glove member and said pocket rim of said pocket respectively into said tube interior and said pocket interior;

gripping said pocket and said filter in said pocket interior with said hand in said tube interior and manipulating said oil filter therewith.

2. A method as in claim 1 wherein the step of providing said oil filter change glove includes the substep of forming said glove to have a seam running longitudinally of said tubularly-shaped outer glove member for attaching said pocket wall to said outer glove member for forming a finger slot between said outer glove member and said pocket wall for receiving a finger inserted therein and said step of inserting said hand includes the substep of inserting a finger into said finger slot.

3. A method as in claim 2 wherein there are two seams running longitudinally of said tubularly-shaped outer glove member for forming said finger slot therebetween.

* * * * *